US009556587B2

(12) United States Patent
Nakazumi et al.

(10) Patent No.: US 9,556,587 B2
(45) Date of Patent: Jan. 31, 2017

(54) HYBRID DEVICE AND HYBRID CONSTRUCTION MACHINE INCLUDING SAME

(71) Applicant: KOBELCO CONSTRUCTION MACHINERY CO., LTD., Hiroshima-shi (JP)

(72) Inventors: Akira Nakazumi, Hiroshima (JP); Yusuke Kamimura, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/790,606

(22) Filed: Jul. 2, 2015

(65) Prior Publication Data

US 2016/0017572 A1 Jan. 21, 2016

(30) Foreign Application Priority Data

Jul. 15, 2014 (JP) ..... 2014-145000

(51) Int. Cl.

| | |
|---|---|
| ***B60K 1/04*** | (2006.01) |
| ***B60K 11/00*** | (2006.01) |
| ***B60K 11/02*** | (2006.01) |
| ***B60K 11/04*** | (2006.01) |
| ***E02F 9/08*** | (2006.01) |

(Continued)

(52) U.S. Cl.

CPC ..... *E02F 9/0866* (2013.01); *E02F 9/0858* (2013.01); *E02F 9/16* (2013.01); *E02F 9/2095* (2013.01); *E02F 9/2275* (2013.01)

(58) Field of Classification Search

CPC ..... B60K 1/04; B60K 11/00; B60K 11/02; B60K 11/04

See application file for complete search history.

(56) References Cited

U.S. PATENT DOCUMENTS

2012/0094165 A1* 4/2012 Valencia, Jr. ..... H01M 10/0525 429/120
2012/0234613 A1* 9/2012 Miyatake ..... E02F 9/0858 180/65.1

(Continued)

FOREIGN PATENT DOCUMENTS

JP 2009-44891 A 2/2009
JP 2012-112102 A 6/2012

(Continued)

OTHER PUBLICATIONS

Extended Search Report issued Dec. 1, 2015 in European Patent Application No. 15176030.3.

(Continued)

*Primary Examiner* — Bryan Evans
(74) *Attorney, Agent, or Firm* — Oblon, McClelland, Maier & Neustadt, L.L.P.

(57) ABSTRACT

A control unit as a hybrid device is provided on a right side deck of an upper slewing body. The control unit has a quadrangular shape in a plan view thereof, and both electric wires and liquid pipelines for cooling or heating the control unit are connected to the control unit. Connection terminals and pipeline connection openings of the control unit are provided on surfaces that form the sides of the quadrangle in a plan view of the casing and that are oriented in different directions.

4 Claims, 4 Drawing Sheets

(51) Int. Cl.

| | |
|---|---|
| ***E02F 9/20*** | (2006.01) |
| ***E02F 9/22*** | (2006.01) |
| ***E02F 9/16*** | (2006.01) |

(56) References Cited

U.S. PATENT DOCUMENTS

| | | | |
|---|---|---|---|
| 2013/0299256 | A1 | 11/2013 | Yamashita |
| 2013/0333963 | A1 | 12/2013 | Goto |
| 2014/0021781 | A1 | 1/2014 | Satake et al. |

FOREIGN PATENT DOCUMENTS

| | | | |
|---|---|---|---|
| JP | 2012-154092 | A | 8/2012 |
| JP | 2012-184586 | A | 9/2012 |
| JP | WO2013/073661 | A1 | 5/2013 |

OTHER PUBLICATIONS

Office Action issued May 24, 2016 in Japanese Patent Application No. 2014-145000 (with English summary unedited computer generated translation).

* cited by examiner

HYBRID DEVICE AND HYBRID CONSTRUCTION MACHINE INCLUDING SAME

TECHNICAL FIELD

The present invention relates to a hybrid device having an improved structure for connecting liquid pipelines and electric wires and a hybrid construction machine including the same.

BACKGROUND ART

The background art will be described by way of an example of a hybrid excavator.

As illustrated in FIG. 5, a hybrid excavator includes a crawler-type lower traveling body 1, an upper slewing body 2 mounted on the lower traveling body 1 so as to slew about an axis perpendicular to the ground surface, and various facilities and devices such as a cabin 4 mounted on an upper frame 3 provided in the upper slewing body 2 as a base. Moreover, a working attachment A including a boom 5, an arm 6, and a bucket 7 is mounted on a front portion of the upper frame 3.

In this specification, the directions "front-rear direction" and "left-right direction" are defined when the position of the cabin 4 is on the left front side.

As illustrated in detail in FIG. 6, the upper frame 3 includes a center section C having a pair of left and right vertical plates 8 serving as a reinforcing member and an attachment mounting member and side decks D1 and D2 provided on both left and right sides of the center section C. An engine 9 as a power source is provided in a rear portion of the center section C.

Moreover, the hybrid excavator includes an generator motor 10 and a hydraulic pump 11 provided on the right side, for example, of the engine 9. The generator motor 10 as a hybrid device operates as a generator and a motor and the generator motor 10 and the hydraulic pump 11 are arranged in the left-right direction.

A cooler 14 and a cooling pump 15 for cooling the hybrid device are provided on the left side of the engine 9 in addition to a radiator 12 and a cooling fan 13 for cooling the engine.

On the other hand, a control unit (inverter) 16 that controls the operation of the generator motor 10 and an electric storage device (not illustrated) as a hybrid power source are provided in a front portion of the right side deck D2. The control unit 16 and the electric storage device are disposed in a vertically stacked state so that the control unit 16 is positioned above and the electric storage device is positioned below, for example. A tank (for example, a fuel tank) 17 is provided on the rear side of the electric storage device and the control unit 16 of the right side deck D2.

The electric storage device may be disposed at a position different from the control unit 16. Moreover, an operating oil tank may be provided instead of the fuel tank 17 and both tanks may be arranged in the front-rear direction or the left-right direction.

Moreover, a slewing motor 18 as a slewing drive source is provided approximately in a central portion of the center section C.

Hereinafter, the generator motor 10, the control unit 16, the electric storage device, and the slewing motor 18 each are sometimes referred to as hybrid device.

In such a hybrid excavator, the hybrid devices (the generator motor 10, the control unit 16, and the electric storage device) are connected by an electric wire such as a power cable for transferring electric power or a signal cable for exchanging a control signal (see Japanese Unexamined Patent Application Publication No. 2012-184586).

Moreover, since it is necessary for these hybrid devices require to be cooled and to be heated, as disclosed in Japanese Unexamined Patent Application, Publication No. 2012-154092, the hybrid devices (the generator motor 10, the control unit 16, and the electric storage device) are connected by liquid pipelines (in the following description as well as the embodiment of the present invention, water pipelines which uses water as a cooling/heating medium is used). Moreover, the hybrid device, the cooler 14, and the cooling pump 15 are also connected by liquid pipelines.

In a hybrid excavator in which water pipelines and electric wires are wired on the upper frame 3 in a state where the water pipelines and the electric wires are mixed together, the following problems may occur in a hybrid device to which both a water pipeline and an electric wire are connected.

For example, the control unit 16 may have a casing that is quadrangular in a plan view thereof and a pipeline connection opening and a connection terminal formed on a side surface of the casing. A water pipeline may be connected to the pipeline connection opening and electric wires (a power cable and a signal cable) may be connected to the connection terminal.

In this case, when connection portions of the pipelines and the electric wires are disposed close to each other on the same surface of the casing, if water leaks from the pipeline connection portion or the vicinity thereof due to a connection failure, or cracks, ruptures or the like in the pipeline, the leaking water may fall directly on the electric wire or the connection terminal.

SUMMARY OF INVENTION

An object of the present invention is to provide a hybrid construction machine which has a hybrid device to which both a liquid pipeline and an electric wire are connected and which is capable of preventing liquid that leaks from a connection portion between the liquid pipeline and the hybrid device or the vicinity thereof from falling directly on the electric wire or the terminal to thereby enhance safety.

In order to solve the problems, the present invention provides a hybrid device provided in a hybrid construction machine, including: a casing that is polygonal in a plan view thereof; a pipeline connection opening which is provided in the casing and to which a liquid pipeline for cooling or heating the hybrid device is to be connected; and a connection terminal which is provided in the casing and to which an electric wire for transferring electric power or a control signal is to be connected, wherein the pipeline connection opening and the connection terminal are formed on surfaces that form sides of the polygon in the plan view of the casing and that are oriented in different directions.

According to the present invention, it is possible to provide a hybrid construction machine which has a hybrid device to which both a liquid pipeline and an electric wire are connected and which is capable of preventing liquid that leaks from a connection portion between the liquid pipeline and the hybrid device or the vicinity thereof from falling directly on the electric wire or the terminal to thereby enhance safety.

DESCRIPTION OF EMBODIMENTS

Hereinafter, an embodiment of the present invention is described with reference to the accompanying drawings. The following embodiment is a specific example of the present invention and is not intended to restrict the technical scope of the present invention.

The present invention is applied to a hybrid excavator in conformity with the description of the background art.

First, a basic configuration of the embodiment of the present invention will be described with reference to FIGS. 5 and 6.

Figure 5:
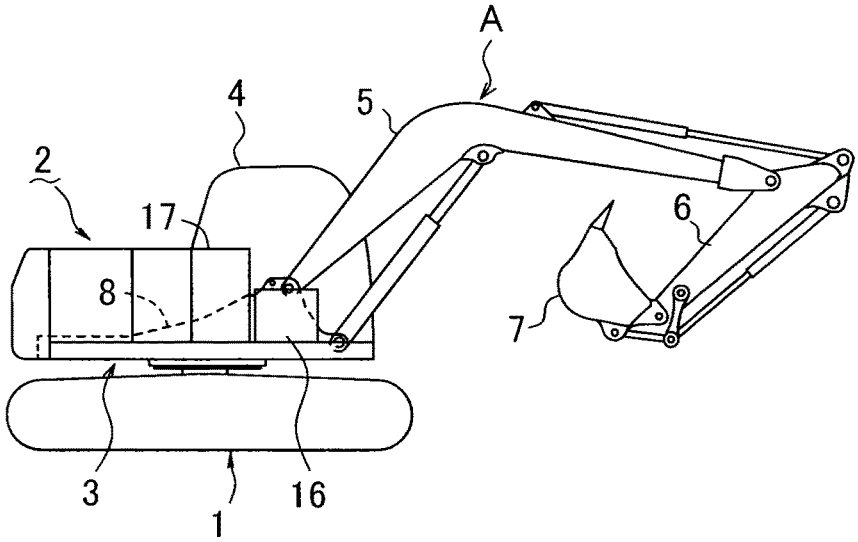
FIG. 5 is a schematic side view of a hybrid excavator to which the present invention is applied.

As illustrated in FIG. 5, a hybrid excavator includes a crawler-type lower traveling body 1, an upper slewing body 2 mounted on the lower traveling body 1 so as to slew about an axis perpendicular to the ground surface, and various facilities and device such as a cabin 4 mounted on an upper frame 3 provided in the upper slewing body 2 as a base.

Moreover, a working attachment A is mounted on a front portion of the upper frame 3. The working attachment A includes a boom 5 having a base end that is rotatably attached to the upper frame 3, an arm 6 that is rotatably attached to a distal end of the boom 5, and a bucket 7 that is rotatably attached to a distal end of the arm 6.

Figure 6:
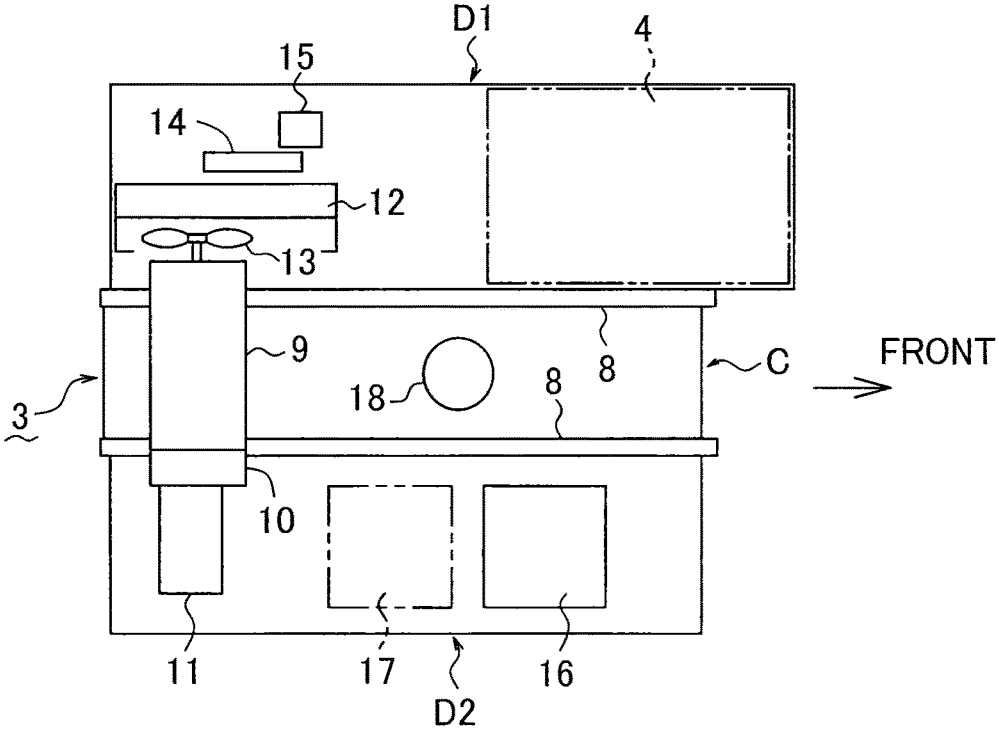
FIG. 6 is a plan view illustrating an upper frame of the hybrid excavator and an arrangement of devices on the upper frame.

As illustrated in detail in FIG. 6, the upper frame 3 includes a center section C having a pair of left and right vertical plates 8 serving as a reinforcing member and an attachment mounting member and side decks D1 and D2 which are beam structures provided on both left and right sides of the center section C. An engine 9 as a power source is provided in a rear portion of the center section C.

Moreover, the hybrid excavator includes a generator motor 10 and a hydraulic pump 11 provided on the right side, for example, of the engine 9. The generator motor 10 as a hybrid device operates as a generator and a motor and the generator motor 10 and the hydraulic pump 11 are arranged in the left-right direction. Moreover, the generator motor 10 and the hydraulic pump 11 are driven by the engine 9.

A cooler 14 and a cooling pump 15 for cooling the hybrid device are provided on the left side of the engine 9 in addition to a radiator 12 and a cooling fan 13 for cooling the engine.

On the other hand, a control unit (inverter) 16 and an electric storage device (not illustrated) as other hybrid devices are provided in a front portion of the right side deck D2. The control unit 16 controls the operation of the generator motor 10. The electric storage device functions as a hybrid power source that supplies electric power to the generator motor 10 and a slewing motor 18 described later. The control unit 16 and the electric storage device are disposed in a vertically stacked state so that the control unit 16 is positioned above and the electric storage device is positioned below, for example. A tank (for example, a fuel tank) 17 is provided on the rear side of the electric storage device and the control unit 16 of the right side deck D2.

The electric storage device may be disposed at a position different from the control unit 16. Moreover, an operating oil tank may be provided instead of the fuel tank 17 and both tanks may be arranged in the front-rear direction or the left-right direction.

The slewing motor 18 as a slewing drive source is provided approximately in a central portion of the center section C.

Hereinafter, a specific configuration of the embodiment according to the present invention will be described with reference to FIGS. 1 to 4.

The hybrid devices (the generator motor 10, the control unit 16, the electric storage device, and the slewing motor 18) are connected by electric wires (that is, power cables 19*a* and 19*b* for transferring electric power and a signal cable 20 for exchanging a control signal).

Since it is necessary for these hybrid devices require to be cooled and heated, the hybrid devices are connected by liquid pipelines (water pipelines) 21 and 22. Moreover, the hybrid device, the cooler 14, and the cooling pump 15 are also connected by the liquid pipelines 21 and 22. The liquid pipelines 21 and 22 are pipelines for guiding a medium (in the present embodiment, water) for cooling or heating the hybrid device.

Figure 1:
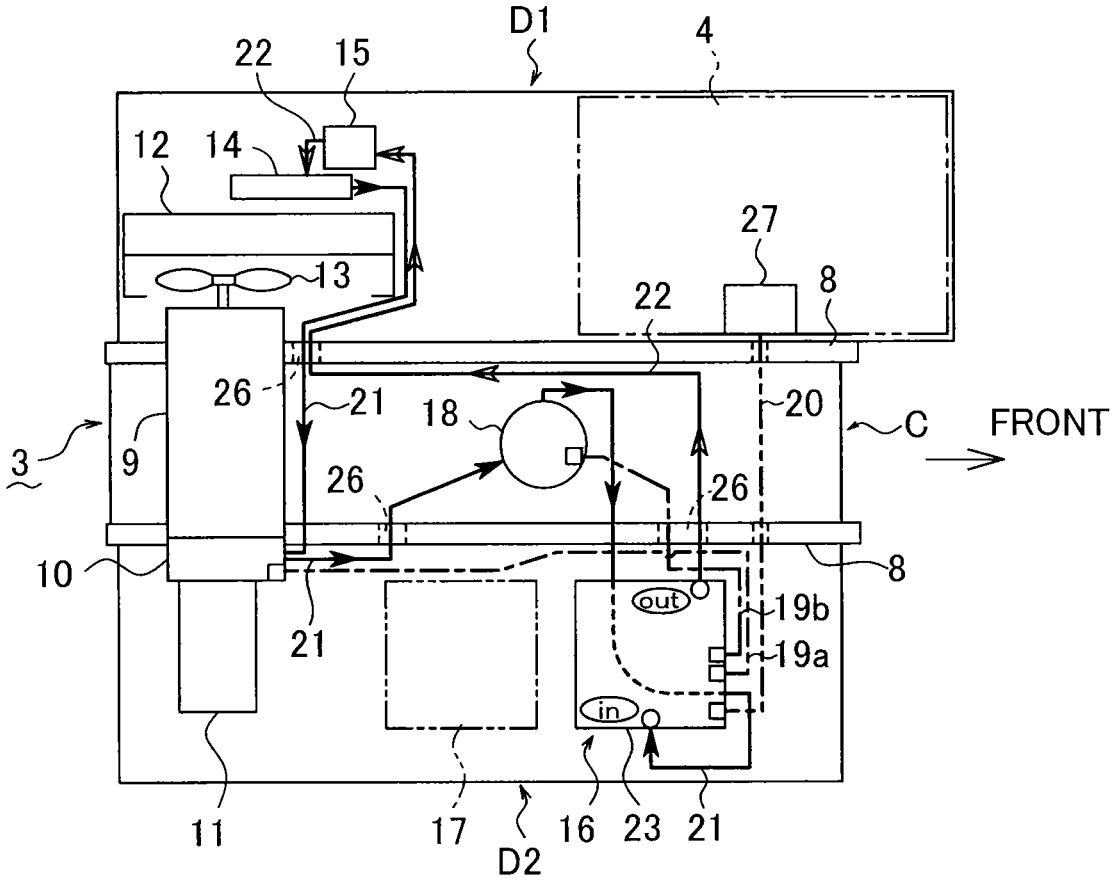
FIG. 1 is a plan view illustrating an upper frame of a hybrid excavator according to an embodiment of the present invention, an arrangement of devices on the upper frame, and the state of pipelines and wires on the upper frame.
Figure 2:
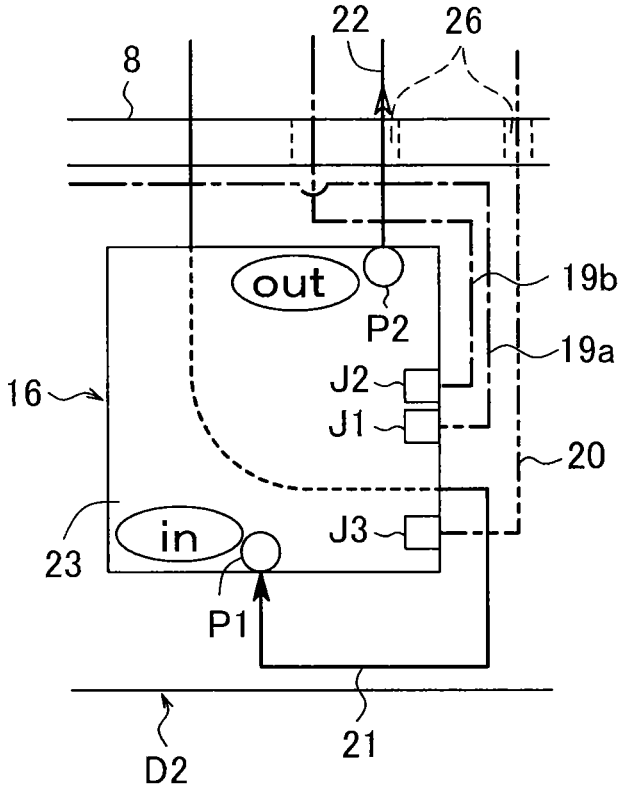
FIG. 2 is an enlarged view of a portion of FIG. 1.

In FIGS. 1 and 2, among the electric wires connecting the hybrid devices, the power cables 19*a* and 19*b* are depicted by a bold one-dot chain line, and the signal cable 20 is depicted by a bold two-dot chain line. In the following description, the respective power and signal cables 19*a*, 19*b*, and 20 are sometimes collectively referred to as "electric wires".

The power cable 19*a* is wired between the generator motor 10 and the control unit 16, and the power cable 19*b* is wired between the control unit 16 and the slewing motor 18. Moreover, the signal cable 20 is wired, for example, between the control unit 16 and a high-level controller 27 (see FIG. 1).

On the other hand, in FIGS. 1 and 2, among the water pipelines, an in-pipeline 21 through which water flows into the control unit 16 is depicted by a black arrowed bold line and an out-pipeline 22 through which water flows from the control unit 16 is depicted by a white arrowed bold line.

The in-pipeline 21 is wired in the path of the cooler 14, the generator motor 10, the slewing motor 18, and the control unit 16.

Moreover, the out-pipeline 22 is wired in the path of the control unit 16, the cooling pump 15, and the cooler 14.

A plurality of passage holes (collectively denoted by reference numeral "26") through which the electric wires 19*a*, 19*b*, and 20 and the liquid pipelines 21 and 22 pass are provided at appropriate positions of the left and right vertical plates 8.

As described above, both the electric wires (respective power and signal cables) 19*a*, 19*b*, and 20 and the liquid pipelines (in-pipeline and out-pipeline) 21 and 22 are connected to the control unit 16. Thus, if water leaks from the connection portions of the liquid pipelines 21 and 22 or the vicinities thereof due to, for example, a connection failure in the liquid pipelines 21 and 22, cracks in the liquid pipelines 21 and 22, or ruptures in the liquid pipelines 21 and 22, the leaking water may have an adverse effect on the electric wires 19*a*, 19*b*, and 20.

Thus, in the present embodiment, the control unit 16 has the following wiring structure.

Figure 3:
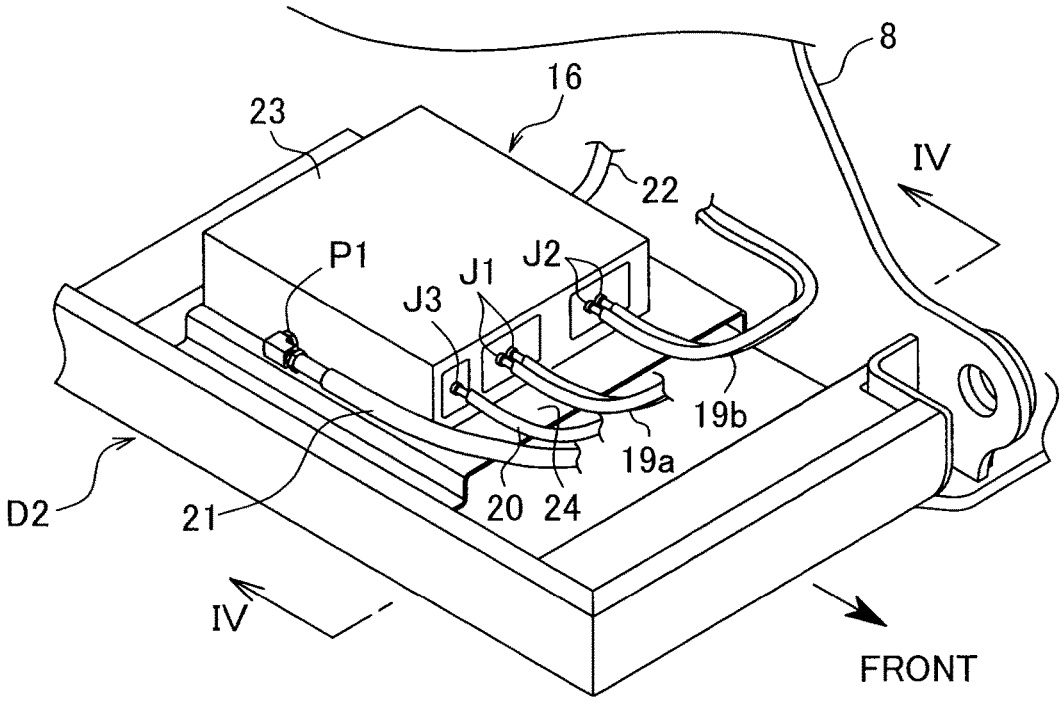
FIG. 3 is an enlarged perspective view of the portion illustrated in FIG. 2.
Figure 4:
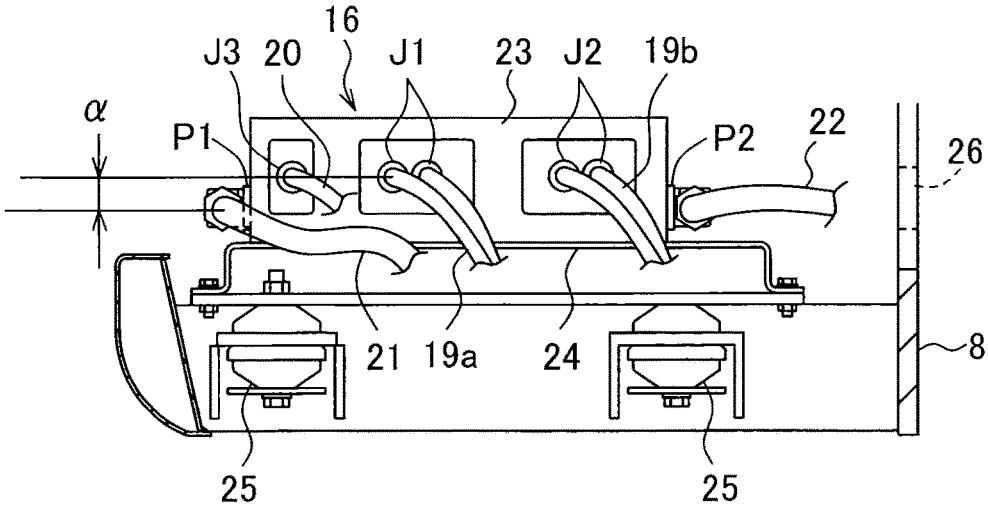
FIG. 4 is an enlarged cross-sectional view along line IV-IV in FIG. 3.

As illustrated in FIGS. 3 and 4, the control unit 16 includes a controller (not illustrated) and a casing 23 that is quadrangular in a plan view thereof and accommodates the controller. The control unit 16 is provided in a front portion of the right side deck D2 with an underframe 24 and a mount member 25 illustrated in FIGS. 3 and 4 interposed.

Moreover, the control unit 16 includes power connection terminals J1 and J2 and a signal connection terminal J3 formed on a front surface of the casing 23. The power cables 19*a* and 19*b* are connected to the power connection terminals J1 and J2 and the signal cable 20 is connected to the signal connection terminal J3.

Further, the control unit 16 includes an in-pipeline connection opening P1 formed on the right side surface of the casing 23 and an out-pipeline connection opening P2 formed on the left side surface of the casing 23. The in-pipeline 21 is connected to the in-pipeline connection opening P1 and the out-pipeline 22 is connected to the out-pipeline connection opening P2.

That is, in the present embodiment, as a first feature, the pipeline connection openings P1 and P2 of the control unit 16 are formed on the left and right side surfaces of the casing 23, and the respective connection terminals J1, J2, and J3 are formed on the front surface of the casing 23. In other wards, the pipeline connection openings P1 and P2 and the connection terminals J1, J2, and J3 are formed on the surfaces (the right side surface, the left side surface and the front surface) that form the sides of the quadrangle in a plan view of the casing 23 and are oriented in different directions. The liquid pipelines (water pipelines) 21 and 22 and the electric wires 19*a*, 19*b*, and 20 are connected to the surfaces of the casing 23 that are oriented in different directions.

Due to this configuration, even if water leaks from the connection portions of the liquid pipelines 21 and 22 or the liquid pipelines 21 and 22 in the vicinities thereof, the leaking water may not fall directly on the electric wires 19*a*, 19*b*, 20 or the connection terminals J1 to J3.

As a second feature, as illustrated in FIG. 4, the respective connection terminals J1 to J3 are provided at positions higher than the pipeline connection openings P1 and P2. In FIG. 4, a indicates a positional shift in a height direction between the connection terminals J1 to J3 and the pipeline connection openings P1 and P2.

By doing so, even when water leaking from the connection portions of the liquid pipelines 21 and 22 accumulates around the connection portions, since the water rarely reaches up to the connection terminals J1 to J3, the safety can be enhanced further.

As a third feature, the pipeline connection openings P1 and P2 and the connection terminals J1 to J3 are formed on the surfaces (the right side surface, left side surface and the front surface) that form the sides of the quadrangle in a plan view of the casing 23.

Due to this, another device (for example, an electric storage device (not illustrated)) can be disposed using the space above or below the casing 23.

Further, according to the present embodiment, the respective connection terminals J1 to J3 of the casing 23 are formed on a surface other than the outer surface (the right side surface) in the vehicle width direction of the right side deck D2. Specifically, the connection terminals J1 to J3 are formed on the surface of the casing 23 that is oriented forward. Due to this, during slewing of the hybrid construction machine, even if the control unit 16 provided on the right side deck D2 makes contact with an external obstacle, the contact is not likely to have an adverse effect on the connection terminals J1 to J3 and severe troubles such as stopped control due to a disconnection can be obviated.

Other Embodiments (1) The connection terminals J1 to J3 may be formed on a surface that forms the sides of a quadrangle in a plan view of the casing 23 and that is oriented in a different direction from the surfaces on which the pipeline connection openings P1 and P2 are formed. For example, the connection terminals J1 and J3 may be disposed on a surface of the casing 23 that is oriented backward or a surface that is oriented toward an inner side (a side close to one of the side decks D1 and D2 in the other side deck) in the vehicle width direction.

(2) The control unit 16 may be provided on the left side deck D1.

(3) In the above embodiment, the control unit 16 has been described as an example of the hybrid device in which both the pipeline connection openings P1 and P2 and the connection terminals J1 to J3 are provided. However, the present invention can be similarly applied to other hybrid devices (for example, the generator motor 10 and the electric storage device) having the same conditions as the control unit 16.

(4) Although the casing 23 that is quadrangular in a plan view has been described, the casing 23 may have a polygonal shape in a plan view thereof.

(5) The present invention is not limited to an excavator but can be broadly applied to other hybrid construction machines such as a hybrid dismantling or crushing machine which uses an excavator as a main body.

The specific embodiment described above mainly includes inventions having following configurations.

The present invention provides a hybrid device provided in a hybrid construction machine, including: a casing that is polygonal in a plan view thereof; a pipeline connection opening which is provided in the casing and to which a liquid pipeline for cooling or heating the hybrid device is to be connected; and a connection terminal which is provided in the casing and to which an electric wire for transferring electric power or a control signal is to be connected, wherein the pipeline connection opening and the connection terminal are formed on surfaces that form sides of the polygon in the plan view of the casing and that are oriented in different directions.

According to the present invention, the pipeline and the electric wire are connected to surfaces (the pipeline connection opening and the connection terminal) of the casing that are oriented in different directions. Thus, even if liquid leaks from a pipeline connection portion or the pipeline, the leaking liquid may not fall directly on the electric wire or the connection terminal.

In the hybrid device, the connection terminal is preferably provided at a higher position than the pipeline connection opening.

According to this configuration, even when liquid (water in particular) leaking from the pipeline connection portion accumulates around the pipeline connection portion, since the liquid rarely reaches up to the connection terminal, the safety can be enhanced further.

The present invention also provides a hybrid construction machine including: a lower traveling body; an upper slewing body that is mounted on the lower traveling body so as to slew; and the hybrid device, wherein the upper slewing body includes an upper frame provided as a base of the upper slewing body, the upper frame including a center section and a pair of side decks provided on both left and right sides of the center section, the hybrid device is provided on one of the side decks, and the connection terminal of the casing is disposed on a surface of the casing that is oriented toward an inner side in a vehicle width direction, a surface of the casing that is oriented forward, or a surface of the casing that is oriented backward.

According to the present invention, the connection terminal is disposed on a side other than the outer side in the vehicle width direction. Thus, during slewing of the upper slewing body, even if the hybrid device provided on the side deck makes contact with an external obstacle, the damage on the connection terminal can be reduced. Thus, it is possible to obviate severe troubles such as a disconnection.

The "inner side in a vehicle width direction" means a side close to one side deck in the other side deck on which the hybrid device is provided.

This application is based on Japanese Patent application No. 2014-145000 filed in Japan Patent Office on Jul. 15, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hybrid construction machine, comprising:

a lower traveling body;

an upper slewing body that is mounted on the lower traveling body so as to slew; and a hybrid device including:

a casing that is polygonal in a plan view thereof;

an in-pipeline connection opening which is provided in the casing and to which an in-pipeline for flowing a medium for cooling or heating to the hybrid device is to be connected, an out-pipeline connection opening which is provided in the casing and to which an out-pipeline for flowing the medium for cooling or heating from the hybrid device is to be connected; and a connection terminal which is provided in the casing and to which an electric wire for transferring electric power or a control signal is to be connected, wherein:

the upper slewing body includes an upper frame provided as a base of the upper slewing body, the upper frame including a center section and a pair of side decks provided on both left and right sides of the center section;

the hybrid device is provided on one of the side decks;

the in-pipeline connection opening, out-pipeline connection opening and the connection terminal are formed on surfaces that form sides of the polygon in the plan view of the casing and that are oriented in different directions, wherein the connection terminal of the casing is disposed on a surface of the casing that is oriented forward, or a surface of the casing that is oriented backward;

the in-pipeline connection opening is disposed on a surface of the casing that is oriented toward one side in a vehicle width direction, and the out-pipeline connection opening is disposed on a surface of the casing that is oriented toward the other side in the vehicle width direction.

2. The hybrid construction machine according to claim 1, wherein the connection terminal is provided at a higher position than the pipeline connection openings.

3. The hybrid construction machine according to claim 1, wherein the connection terminal of the casing is disposed on the surface of the casing that is oriented forward.

4. The hybrid construction machine according to claim 1, wherein the hybrid device includes at least an electric motor.

* * * * *